US010099827B1

(12) United States Patent
Levy Sarraf

(10) Patent No.: US 10,099,827 B1
(45) Date of Patent: Oct. 16, 2018

(54) DUAL FUNCTION DISPENSING CAP

(71) Applicant: Natalie Levy Sarraf, Santa Monica, CA (US)

(72) Inventor: Natalie Levy Sarraf, Santa Monica, CA (US)

( * ) Notice: Subject to any disclaimer, the term of this patent is extended or adjusted under 35 U.S.C. 154(b) by 0 days.

(21) Appl. No.: 15/096,233

(22) Filed: Apr. 11, 2016

(51) Int. Cl.
*B67B 1/00* (2006.01)
*B65D 47/26* (2006.01)
*B65D 43/16* (2006.01)

(52) U.S. Cl.
CPC ..... *B65D 47/266* (2013.01); *B65D 43/161* (2013.01)

(58) Field of Classification Search
CPC ..... B65D 2251/1016; B65D 47/266; B65D 47/08; B65D 47/30; B65D 43/169; B65D 51/18; B65D 47/265; B65D 55/16; B65D 2251/0053; B65D 2251/1083; B65D 2251/1058
USPC ..... 222/153.14
See application file for complete search history.

(56) References Cited

U.S. PATENT DOCUMENTS 4,284,200 A * 8/1981 Bush ..... B65D 47/0842 215/215
4,548,331 A * 10/1985 Montgomery ..... B65D 50/045 220/253
5,601,213 A * 2/1997 Daniello ..... B65D 41/26 222/456
2007/0199959 A1* 8/2007 Getsy ..... B65D 47/265 222/480
2008/0087690 A1* 4/2008 Parve ..... B65D 47/0847 222/485
2015/0223623 A1* 8/2015 Davis ..... A47G 19/2272 220/714

* cited by examiner

*Primary Examiner* — Benjamin R Shaw
(74) *Attorney, Agent, or Firm* — Law Offices of Natan Epstein

(57) ABSTRACT

A dual function dosing cap has an inner cap and an outer cap rotatable on the inner cap, first and second liquid dispensers on the inner cap, first and second access holes on the outer cap, the access holes being in overlying alignment with respective ones of the liquid dispensers in an open position of the outer cap, and wherein rotation of the outer cap to a closed position moves the access holes out of overlying alignment; first and second lids hinged to the outer cap for individual lifting open and closing for covering the first and second access holes respectively in a closed condition of the lids. Duct segments on each cap telescope to form ducts bridging the intra-cap space. Plugs and caps on the outer cap act as stoppers closing the liquid dispensers in both the open and closed positions of the dosing cap.

22 Claims, 9 Drawing Sheets

DUAL FUNCTION DISPENSING CAP

BACKGROUND OF THE INVENTION

Field of the Invention

This invention pertains to the field of caps and closures for containers such as bottles, and more particularly relates to dosing caps used for dispensing controlled amounts of liquids in clinical, pharmaceutical, cosmetic and food industries, among other possible applications.

SUMMARY OF THE INVENTION

A dual function dispensing or dosing cap is provided having a cap body adapted for attachment to the neck of a bottle, vial or other container, first and second liquid dispensers, and a lid assembly including separately operable lids for selectively accessing one or the other of the liquid dispensers.

The two liquid dispensers may be chosen to have different functionalities, so that one or the other dispenser can be selected for dispensing liquid content, as may be most appropriate at a particular time. In one embodiment of the invention, one of the two liquid dispensers is a flow reducer opening and the other liquid dispenser is a normally closed elastomeric septum penetrable by the blunt ended tip of an oral syringe The dosing cap body is an assembly including an inner cap engageable to a bottle neck and an outer cap rotatable on the inner cap. The first and second liquid dispensers are installed on the inner cap and the outer cap carries the lid assembly. Rotation of the outer cap turns the lid assembly between an open position and a closed position.

The lids are hinged to a top of the outer cap along a hinge line which lies across a diameter of the outer cap, and under each lid is a corresponding access hole defined in the cap top. In the open position of the outer cap the two access holes are in overlying alignment with the first and second liquid dispensers and the hinge line lies between the two dispensers. The outer cap can be turned about the lower cap ninety degrees to a closed position in which the hinge line lies across the two liquid dispensers. In the open condition of the outer cap, lifting a corresponding lid exposes and admits access to one or the other liquid dispensers in the lower cap through a corresponding access hole in the upper cap. By turning the outer cap ninety degrees relative to the inner cap to its closed position, the access holes in the outer cap are moved away from overlying alignment and both liquid dispensers are covered by portions of the upper cap, preventing access to the same.

The lids are hinged, constructed and configured such that lifting or opening one lid mechanically limits or prevents lifting of the other lid, so that only one of the liquid dispensers can be uncovered for access at any one time.

The dosing cap may have first and second pairs of flow stoppers for closing the dosing cap against flow of liquid. The first pair of stoppers includes two plug elements each dependent from one of the lids for corking the liquid dispensers in an open condition of the upper cap but in a closed position of the lids. The second pair of stoppers may be a pair of caps dependent from the underside of the inner cap for capping the liquid dispensers in a closed condition of the outer cap relative to the inner cap.

A pair of ducts may be provided between each of the access holes in the outer cap and a corresponding liquid dispenser on the inner cap for containing and directing the flow of liquid and avoiding leakage into the space between the upper and lower caps when dispensing liquid through the cap assembly. In one embodiment of this invention the ducts may be formed by a first pair of duct segments supported on the inner cap, each duct segment encompassing one of the liquid dispensers, and a second pair of duct segments dependent from the upper cap each encompassing one of the two access holes. Each duct segment of the first pair couples telescopically with a corresponding duct segment of the second pair to form two tubular ducts bridging the intra-cap space between each liquid dispenser and a corresponding access hole.

In this form of the invention, turning of the outer cap between its open and closed positions entails axial lifting and seating motions of the outer cap relative to the lower cap to achieve telescopic uncoupling and coupling of the duct segments and unseating and seating of the plugs and caps dependent from the upper cap.

Positive indexing of the outer cap relative to the inner cap may be provided by a pin and slot arrangement for guiding and limiting the axial and rotational movements of the upper cap in relation to the inner cap between the open and closed positions. This arrangement may feature a radial guide pin extending from the inner cap into a guide slot defined in the outer cap. The guide slot may extend ninety degrees of arc circumferentially about the outer cap to limit turning movement of the upper cap to an arc extending between the open and the closed positions of the upper cap. Additionally, the guide slot may include two vertical segments, one at each end of the circumferential arc, for guiding and limiting axial displacement of the outer cap at the open and closed positions to a degree sufficient for seating and unseating the plugs and for coupling and uncoupling the duct segments.

A cap safety lock may be provided for normally locking the outer cap against movement relative to the inner cap in one or both of the open and the closed conditions. The cap safety lock may take the form of a detent pin on one of the caps spring biased towards entry into either of two circumferentially spaced apart detent holes in the other of the caps. The locations of the detent holes correspond to the open and closed positions of the outer cap. The detent or push pin is movable between a radially extended and a radially depressed position. In the extended or locking position the push pin enters one of the detent holes and prevents movement of the upper cap, either axial or rotational, relative to the lower cap. The push pin is normally biased towards the extended or locking position, such that the pin tends to enter one or the other of the detent holes as the pin comes into alignment with either hole when the outer cap is turned over the inner cap, thereby locking the two caps against relative rotation. When manually depressed, the push pin is pushed out of the detent hole thereby freeing the outer cap for movement between the open and closed positions.

In an embodiment intended for permanent installation of the dosing cap on a necked container, the lower cap may have cap retainers or fasteners shaped and configured to make non-removable interlock with corresponding complementary cap retaining portions on the bottle neck, so that the dosing cap once fitted to such a bottle neck cannot be readily detached and removed from the bottle by pulling or twisting.

These and other improvements, features and advantages of this invention will be better understood by reference to the following detailed description taken in conjunction with the accompanying drawings.

DETAILED DESCRIPTION OF THE PREFERRED EMBODIMENT

Figure 1:
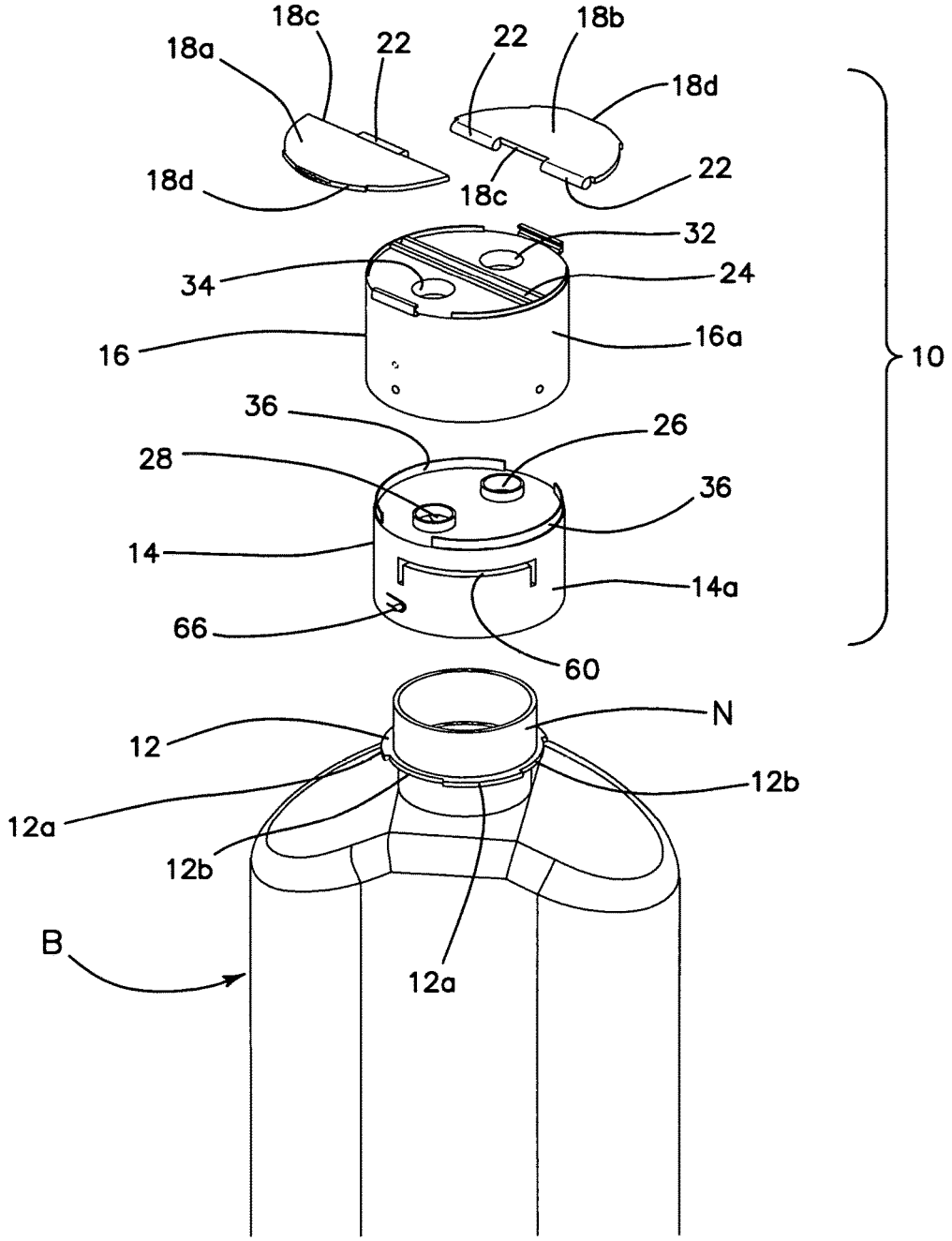
FIG. 1 is an axially exploded perspective view of a presently preferred embodiment of the dual function dosing cap of this invention shown in relation to a typical bottle provided with an interlocking bottle neck.

With reference to the accompanying drawings, wherein like elements are designated by like numerals, FIG. 1 depicts a dosing cap according to this invention and generally designated by numeral 10, shown with a typical bottle B. Bottle B has a bottle neck N provided with a cap retaining collar 12 which cooperates with retaining elements in the cap 10 as will be explained below, such that once fitted to the bottle neck N the dosing cap 10 cannot be detached from the bottle by twisting or pulling.

Figure 2:
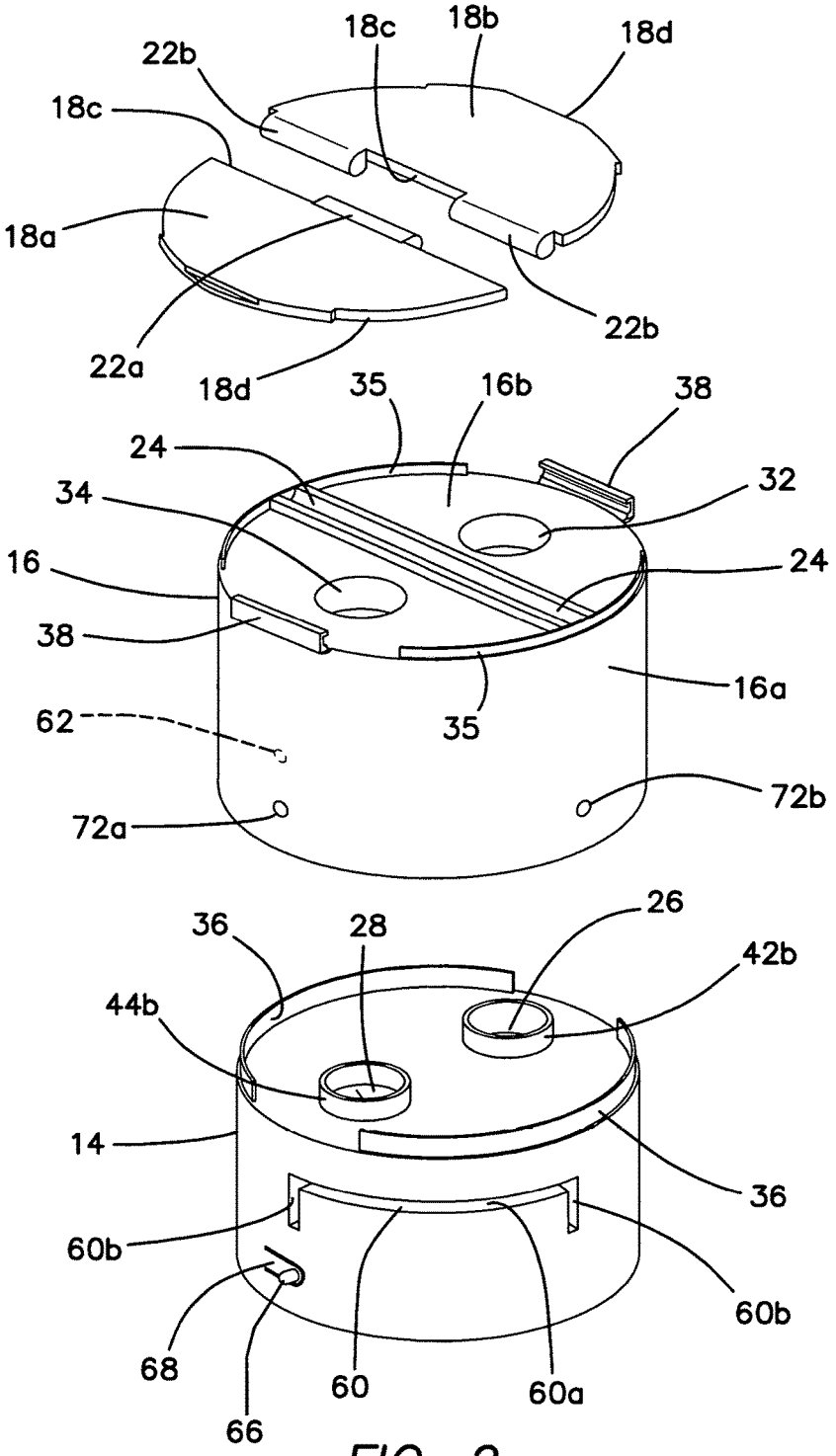
FIG. 2 is an enlarged view as in FIG. 1 of the dosing cap according to this invention.

As seen in FIG. 2, dosing cap 10 includes an inner cap 14, an outer cap 16. Inner cap 14 has a cylindrical side wall 14*a* and a top surface 14*b*. Outer cap 16 likewise has a side wall 16*a* and top surface 16*b*. Outer cap 16 is sized so that side wall 16*a* makes a close sliding fit about side wall 14*a* of inner cap 14 in an assembled condition of cap 10, as shown in FIGS. 6 through 10, such that the outer cap can be turned by hand over inner cap 14.

Figure 4:
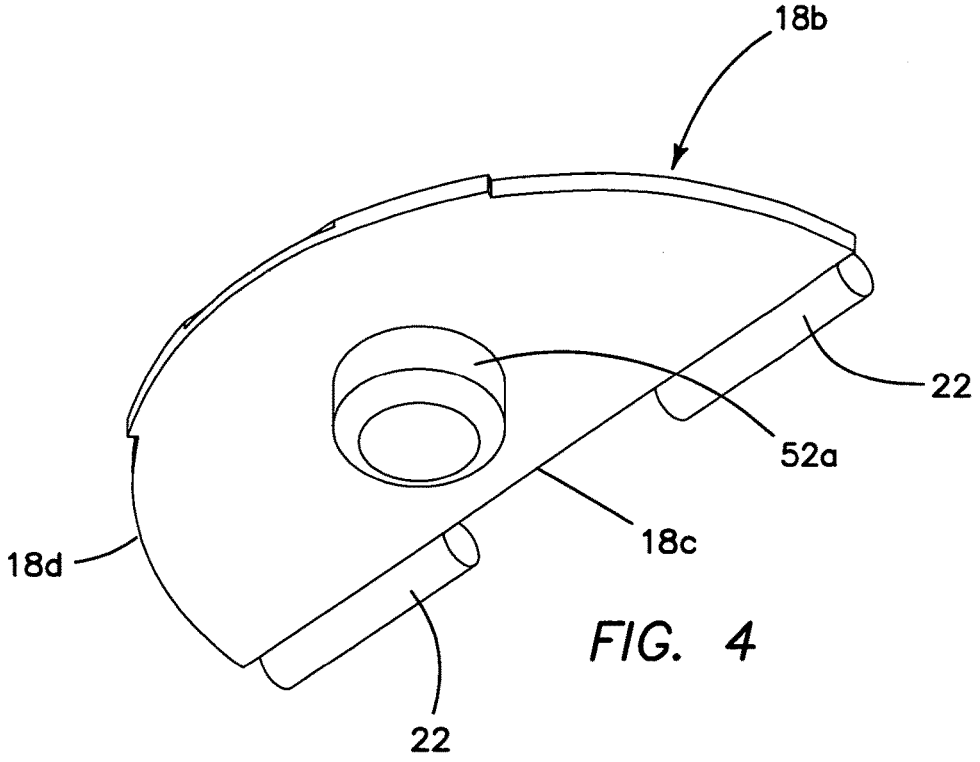
FIG. 4 is a perspective view showing the underside of one of the two lids of the dosing cap of FIG. 1.

A lid assembly includes two lids 18*a* and 18*b* hinged to outer cap 16. Each of lids 18*a*, 18*b* have inner edges 18*c* and arcuate outer edges 18*d*. As best seen in FIG. 4, the two lids also have hinge ears 22 extending from inner edges 18*c*: two hinge ears 22 spaced apart along edge 18*c* of lid 18*b*, and a single hinge ear 22 centered along edge 18*c* of lid 18*a*. A hinge trough 24 of approximately semicircular interior cross section, seen in FIGS. 6 and 7, extends diametrically across top surface 16*b*, and is cross-sectionally shaped to receive and retain the hinge ears 22 of the two lids 18*a*, 18*b*, so that the two lids are hinged to top surface 16*b* of outer cap 16 along trough 24. Each lid 18*a*, 18*b* is free to swing about a hinge line centered in trough 24 between a lowered, closed position against top surface 16*b* and a raised, open position with outer edge 18*d* lifted away from top surface 16*b*. Diametrically opposite lid supports 35 are provided along the rim of top surface 16*b* for supporting the closed lids 18*a*, 18*b* in a level position parallel to surface 16*b*. A pair of lid latches 38 are hinged to the edge of top surface 16*b*, each of which can swing over the outer edge 18*d* of a corresponding lid 18*a*, 18*b* for securing the lid in a closed position against top surface 16*b* of outer cap 16, as shown on the left side of FIG. 6 and the right side of FIG. 7. Lifting latches 38 releases the corresponding lid for lifting movement, as shown on the right side of FIG. 6 and the left side of FIG. 7.

Figure 9:
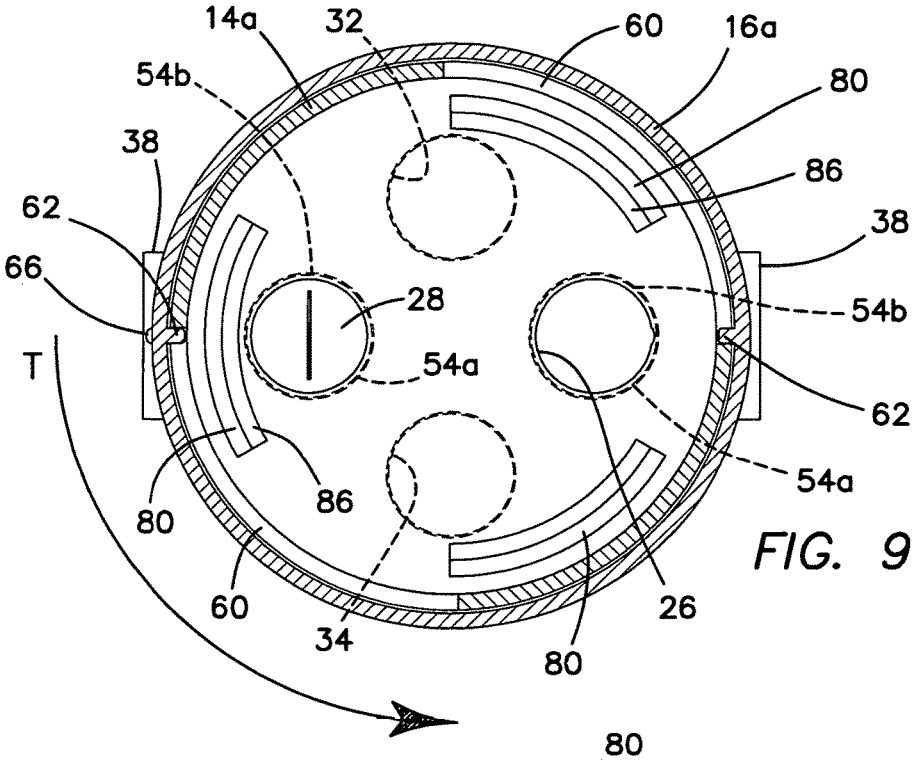
FIG. 9 is an axial cross section of the assembled dosing cap taken along line 9-9 in FIG. 11 showing the guide pins extending radially into the respective guide slots and the outer cap in its closed position relative to the inner cap.

Inner cap 14 carries two liquid dispensing elements including a flow reducer opening 26 and a self-resealing elastomeric septum 28 supported in opening 28*a*. The dispensers 26, 28 are located on diametrically opposite sides of hinge trough 24, each under a corresponding lid 18*a*, 18*b*. Outer cap 16 has a pair of access holes 32, 34 in its top surface 16*b*. The centers of holes 32, 34 are spaced apart along a diameter of top surface 16*b* by a distance approximately equal to the spacing between the centers of flow reducer opening 26 and self-resealing elastomeric septum 28 on top surface 14*b* of inner cap 14. Turning outer cap 16 in relation to inner cap 14 moves access holes 32, 34 into and out of overlying alignment with dispenser elements 26, 28. The aligned position is referred to as the open position of dosing cap 10, while a 90 degree out-of-alignment position, depicted in FIG. 9, is referred to as the closed position of the dosing cap 10.

In the open condition of outer cap 16, lifting one lid 18*a*, 18*b* admits access to either the flow reducer opening 26 or the septum 28 in the inner cap 14 through a corresponding access hole 32, 34 in the outer cap 16. By turning the outer cap 16 ninety degrees relative to the inner cap to the closed position, the access holes 32, 34 in the outer cap no longer overlie the flow reducer opening 26 and the septum 28, and in this closed position both the flow reducer opening and the septum are covered by top portions of the upper cap 16 even when either lid 18*a*, 18*b* is lifted.

Inner cap 14 has diametrically opposed cap spacers 36 which support outer cap 16 above cap 14 in slightly spaced relationship to provide an intra-cap space 37. A pair of ducts 42, 44 serve to bridge the intra-cap space to avoid or minimize spillage of liquid flowing through the dosing cap 10. Each duct 42, 44 includes an upper duct segment 42*a*, 44*a* telescopically coupled to a corresponding lower duct segment 42*b*, 44*b*. The upper duct segments depend from the underside of outer cap 16 while lower ducts segments stand on top surface 14*b* of inner cap 14. The bottom end of lower duct 42*b* encompasses the flow reducer opening 26 and the bottom end of lower duct 44*b* encompasses the elastomeric septum 28. The top end of upper duct 42*a* encompasses access hole 32 and the top end of upper duct 42*b* encompasses access hole 34. The free ends of the upper and lower ducts couple together by telescopically sliding into each other to provide two continuous fluid conduits or ducts substantially closed to the intra-cap space 37 between caps 14 and 16.

Dosing cap 10 also has two pairs of flow stoppers for plugging or capping liquid flow from the liquid dispensers 26, 28 through ducts 42, 44. A first stopper pair 52*a*, 52*b* serves to plug the access holes 32, 34 of cap 10 when lids 18*a*, 18*b* are lowered, in both the open and closed position of the outer cap 16. A second stopper pair 54*a*, 54*b* caps the lower duct segments 42*b*, 44*b* in the closed position of the outer cap 16 in which the upper and lower duct segments are uncoupled from each other.

Figure 3:
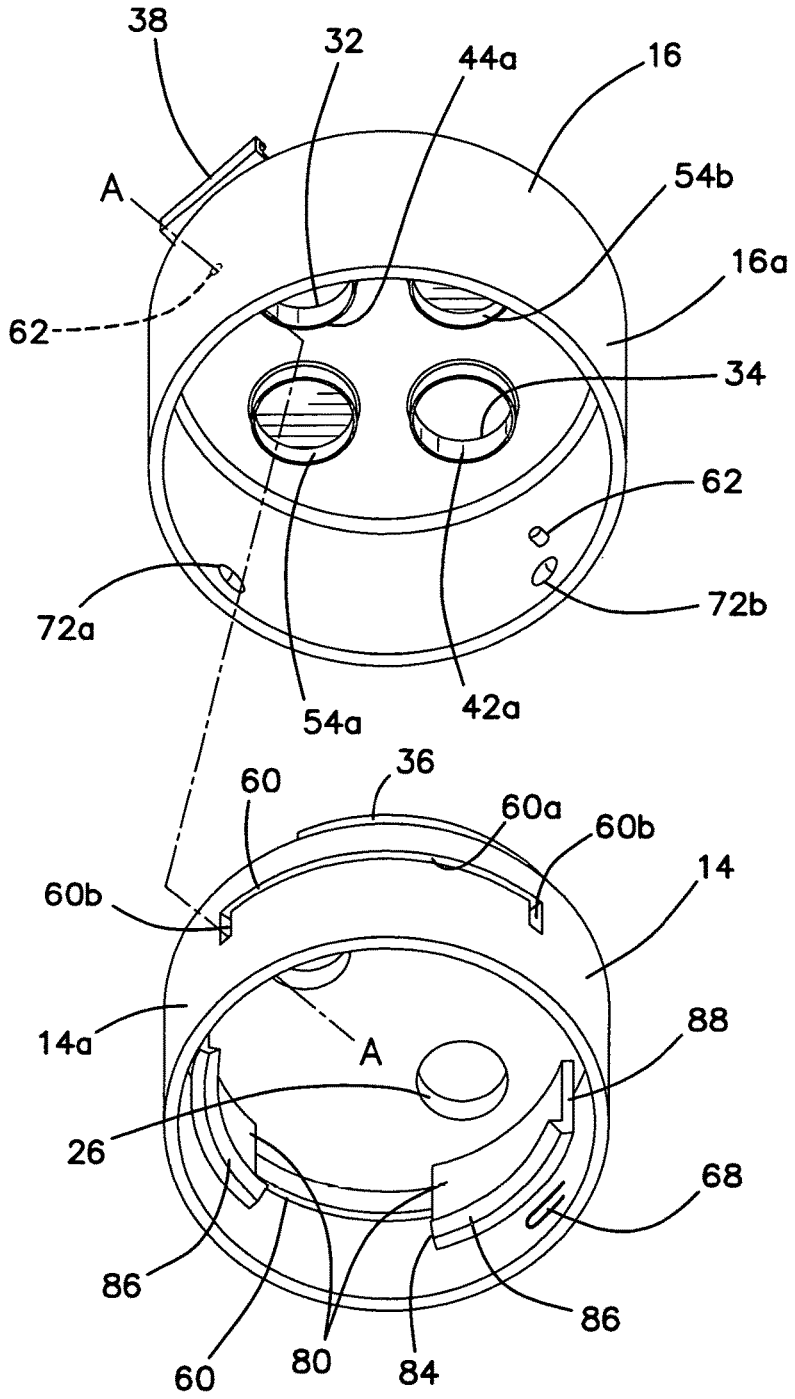
FIG. 3 is a perspective view showing the underside of the separate outer and inner caps of the dosing cap.
Figure 5:
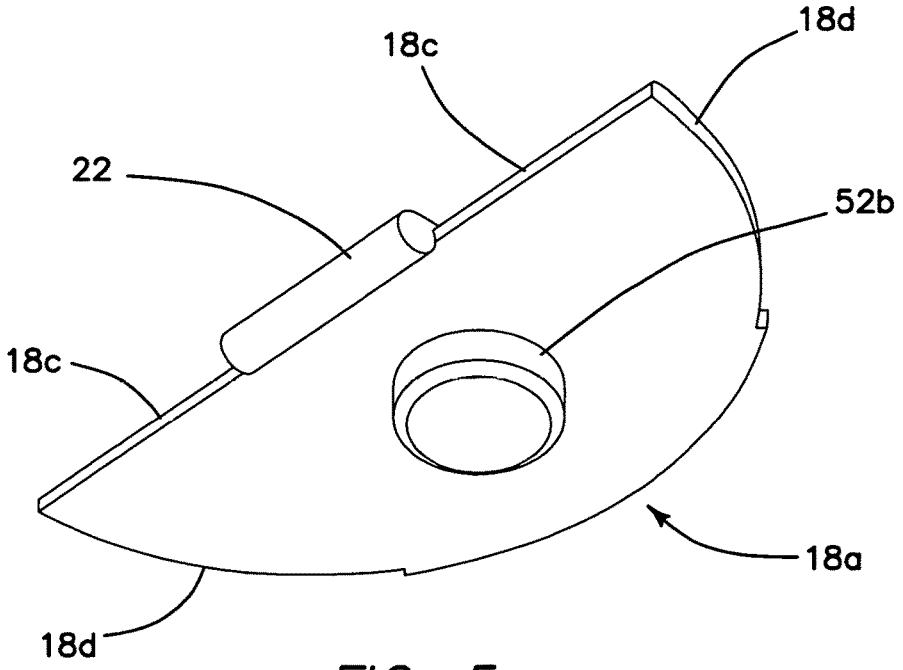
FIG. 5 is a perspective view showing the underside of the other of the lids of the dosing cap.

Plugs 52*a*, 52*b* are each dependent from the underside of a corresponding lid 18*a*, 18*b*, as best seen in FIGS. 4 and 5 of the drawings. Plugs 52*a*, 54*b* seat into corresponding access holes 32, 34 when the lids 18*a*, 18*b* are pressed down to a closed position against the top 16*b* of cap 16. Caps 54*a*, 54*b* are dependent from the underside of outer cap 16 as shown in FIG. 3. Caps 54*a*, 54*b* seat onto the open upper ends of lower duct segments 42*b*, 44*b* when the outer cap 16 is in its closed position.

Actuating outer cap 16 between its open and closed position calls for both up and down axial movements of the outer cap 16, and turning motion of the outer cap between the two axial movements. A three step sequence is needed: first an axial lifting or unseating of outer cap 16 away from inner cap 14, then turning of outer cap about its axis relative to inner cap 14 to its new position, and thirdly axially pressing or seating outer cap 16 onto inner cap 14 in the new position.

Figure 10:
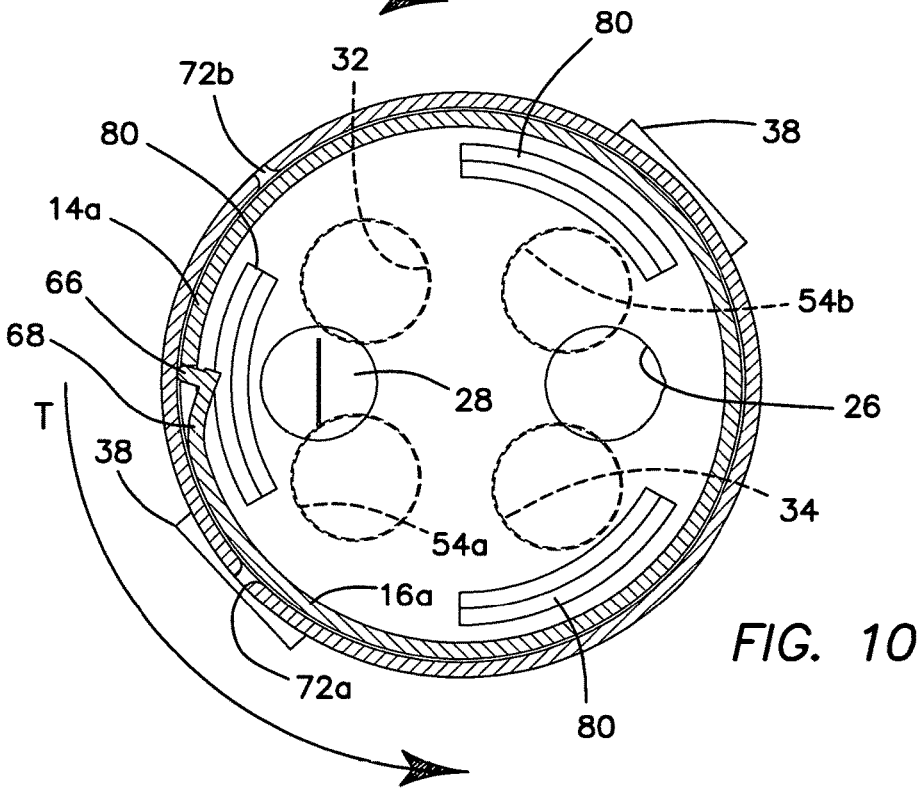
FIG. 10 is an axial cross section of the assembled dosing cap taken along line 10-10 in FIG. 11 showing the push pin pressed inwardly and the outer cap turned at an intermediate position between its open and closed positions relative to the inner cap.

FIG. 9 shows dosing cap 10 in its closed position where the liquid dispensers 26, 28 are capped by caps 54*a*, 54*b* respectively, shown in phantom lining, and guide pins 62 each abut against one end of corresponding guide slot 60, with push pin 66 extending axially through side wall 16*a* of outer cap 16, locking caps 16, 14 against relative movement. Arrow T in FIGS. 9 and 10 indicates the direction of rotation for turning outer cap 16 from the closed to the open position. FIG. 10 illustrates outer cap 16 turned partially towards the open position with push pin 66 in axially depressed condition within side wall 16*a* where the resiliency of spring arm 68 urges pin 66 against the side wall 14*a*. In this condition the outer cap 16 is free to turn relative to inner cap 14 until detent hole 72*b* reaches alignment with depressed push pin 66 whereupon pin 66 enters the detent hole under urging of spring arm 68, locking the caps 14, 16 against further rotation in the open position. For closing cap 10 push pin is pressed out of detent hole 72*b* and outer cap 16 is turned in a direction opposite to arrow B until detent hole 72*a* comes into alignment admits push pin 66 which then again locks caps 14, 16 together, this time in the closed position.

This three step movement is guided and facilitated by two diametrically opposed guide slots 60 cut in the side wall 14*a* of inner cap 14, as best seen in FIGS. 2, 3 and 9 of the drawings. Each guide slot 60 has a horizontal mid-portion 60*a* extending 90 degrees circumferentially about side wall 14*a* and terminates at each end in a downwardly extending vertical slot segment 60*b*. A pair of diametrically opposed guide pins 62 on side wall 16*a* of outer cap 16 project radially inwardly and into a corresponding one of the two guide slots 60 when caps 16 and 14 are assembled, as suggested by the dotted line A-A in FIG. 3. The two guide pins 62 travel along guide slots 60 to limit movement of the outer cap 16 to the aforementioned three steps required to operate dosing cap 10 between its open and closed positions.

Figure 11:
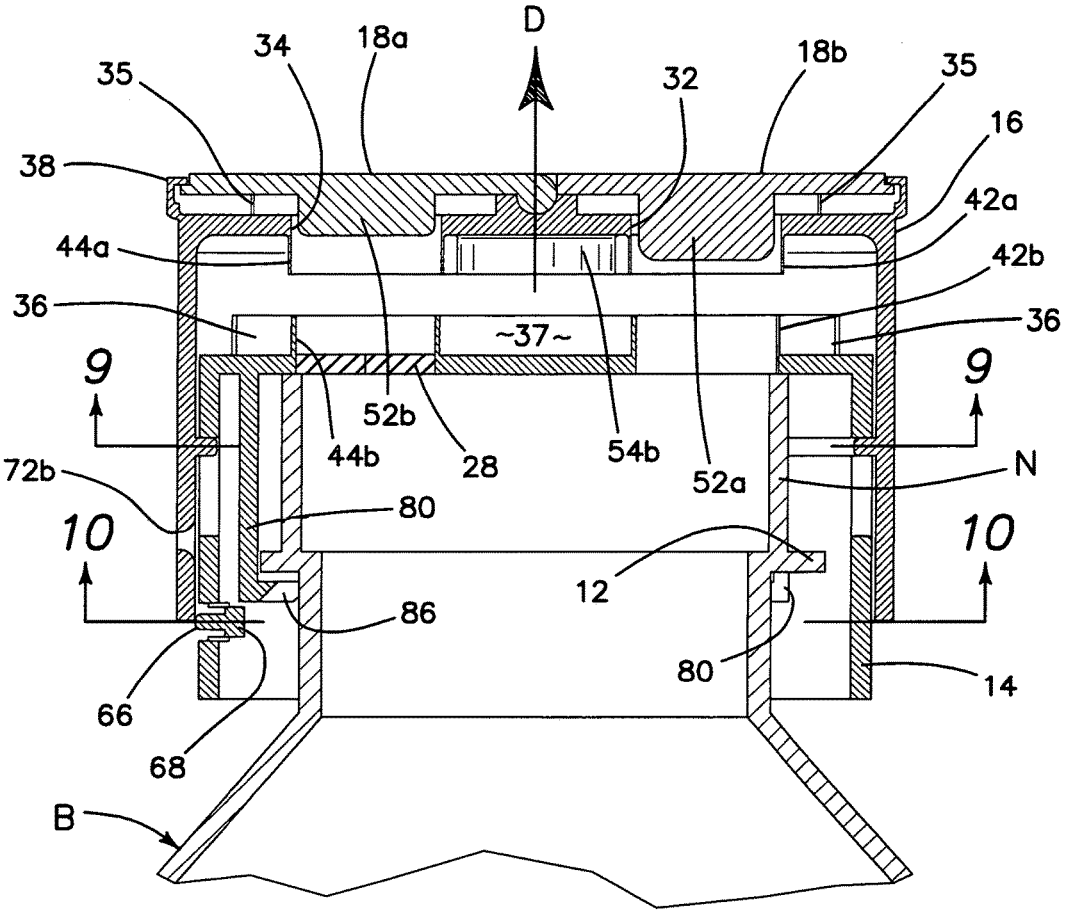
FIG. 11 is an elevational cross section as in FIG. 6 showing the upper cap axially lifted away from the lower cap for uncoupling the duct segments and unseating the stopper elements in preparation for turning the outer cap from the illustrated open position to its closed position.

FIG. 11 depicts the axial lifting of outer cap 16 along arrow D away from inner cap 14 in the open position. This axial lifting decouples and separates the upper duct segments 42*a*, 44*a* on outer cap 16 from the corresponding lower duct segments 42*b*, 44*b* on inner cap 14 axial lifting is guided and limited by guide pins 66 captive in vertical slot segments 60*b*. Once pins 66 reach the upper ends of vertical slot segments 60*b* the pins 66 are in vertical alignment with the horizontal or circumferential portion 60*a* of guide slot 60. Outer cap 16 can now be turned between its open and closed positions to an extent limited by travel of pins 66 between the opposite ends of slot segment 60*a*. After turning from the open to the closed position, axially seating outer cap 16 in its closed position onto inner cap 14 seats caps 54*a*, 54*b* onto the lower duct segments 42*b*, 44*b*, thereby capping the free ends of the lower duct segment.

A cap safety lock may be provided as a child resistant feature for locking outer cap 16 against movement relative to cap 14 in either or both the open or closed positions of dosing cap 10. The cap safety lock includes a first detent in the form of push pin 66 projecting radially outwardly from a free end of a spring arm 68 cut from side wall 14*a* of inner cap 14. The spring arm 68 provides a spring bias which urges the pin 66 towards a normally extended condition seen in FIGS. 2 and 3. The pin 66 can be depressed by manually pushing it and bending the spring arm 68 into cap 14 against the tendency of arm 68 to return to its normal condition co-planar with side wall 14*a*. The cap safety lock also includes a second cap detent in the form of one or both of a pair of detent holes 72*a* and 72*b* in side wall 16*a* of the outer cap 16. The holes 72*a*, 72*b* are circumferentially spaced apart by 90 degrees, the same spacing as between the two vertical guide slot segments 60*b*. Each detent hole is situated for receiving push pin 66 under urging of the bent spring arm 68 as pin 66 comes into alignment with either hole as a result of rotation of outer cap 16 relative to inner cap 14 from one to the other of its open and closed positions.

Figure 6:
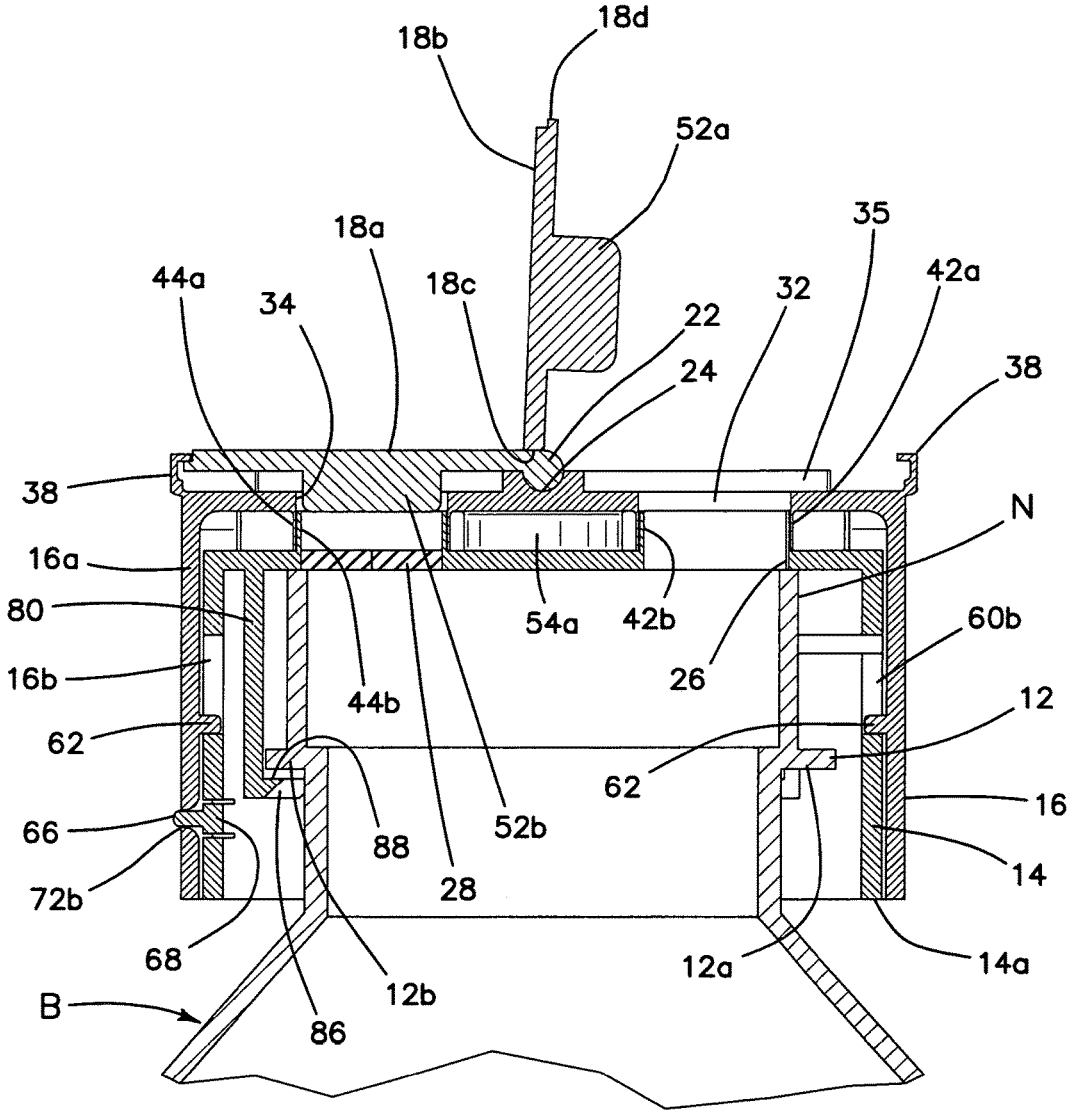
FIG. 6 is an elevational cross section of the assembled dosing cap fitted to the interlocking bottle neck of FIG. 1 and shown with the outer cap in open position with one lid lifted for access to the flow reducer opening.
Figure 7:
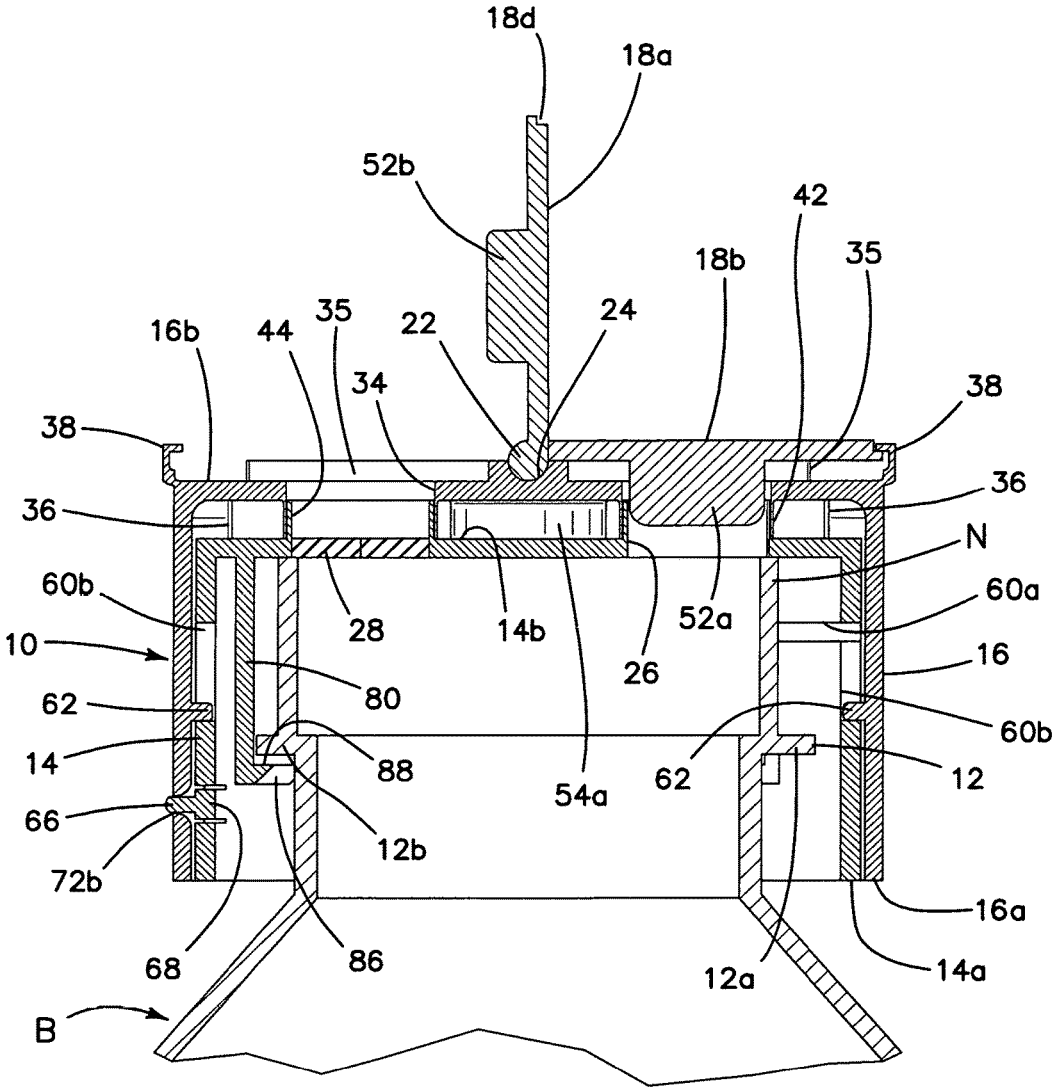
FIG. 7 is a cross section as in FIG. 6 with the other lid lifted for access to the elastomeric septum.
Figure 8:
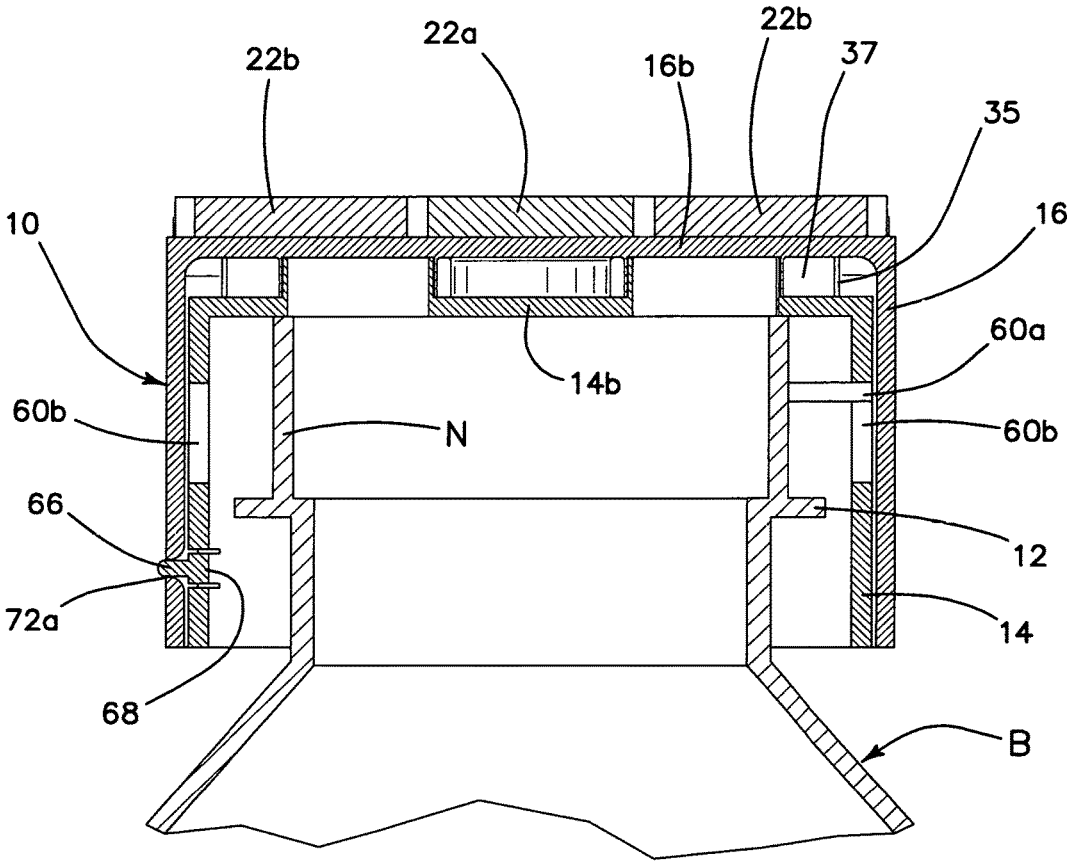
FIG. 8 is a vertical cross section of the dosing cap as in FIG. 6 with the outer cap turned to its closed position with both liquid dispensers capped and showing both lids lowered to a closed position.

As seen in FIGS. 6 and 7, the lids 18*a* and 18*b* hinged to outer cap 16 are constructed and configured such that lifting one lid to its open position places the inner edge 18*c* of the open lid over and against the top surface of the closed other lid, thereby blocking and preventing lifting of the closed lid. Consequently, only one of the two lids cap be lifted open and access gained to only one of the liquid dispensers 26, 28 at any one time. This feature ensures that liquid is not spilled from a second one of the two dispensers while liquid is being dispensed from a first one the two dispensers, as the second dispenser remains plugged by a corresponding one of the two plugs 52*a*, 52*b* while the first dispenser is in use.

Dosing cap 10 may be permanently fastened to the neck N of a bottle B or other container by cap retainers 80 spaced circumferentially on the inside of side wall 14*a* of the inner cap 14, each cap retainer shaped to interlock axially and circumferentially with a retaining collar 12 on the bottle neck N, seen in FIG. 1. The retaining collar 12 has segments of greater radial width 12*a* separated by segments 12*b* of lesser radial width. Cap retainers 80, best seen in FIGS. 3 and 9, each have an upper portion 82 of inside diameter sized to closely fit over the outside diameter of collar segments 12*b*. Each cap retainer 80 also extends along a circumferential arc sized to closely fit between two adjacent collar segments 12*a* of retaining collar 12. Inner cap 14 can fit over retaining collar 12 and seat onto bottle neck 12 with one cap retainer 80 between each contiguous pair of collar segments 12*a*. The circumferential interposition of cap retainers 80 between collar segments 12*a* prevents inner cap 14 from turning about neck bottle N. Each cap retainer 80 also has a circumferential tooth 84 having a minimum inside diameter smaller than the outside diameter of collar segments 12*b*, but sized to permit a press fit over the retaining collar 12. The circumferential teeth 84 each have a tapering ramp surface 86 designed to slide over the outer edges of collar segments 12*b* and to admit the collar 12 past circumferential teeth 84 into cap 14. Entry of collar 12 into cap 14 is one-directional and irreversible for practical purposes. Once cap 14 is pressed down over collar 12 and both parts return to their normal unstressed dimensions, the upper surfaces 88 of teeth 84 have an inside diameter smaller than the outside diameter of collar segments 12*b*, so that teeth 84 make an interference fit with collar 12 both axially and circumferentially and prevent separation and removal of dosing cap 10 from bottle neck N, making the installation of dosing cap 10 on container B permanent for practical purposes. This feature helps prevent opening of the container B, especially by children who might ingest and overdose on contents of the container.

The elastomeric septum 28 may be a disk of elastomeric material with a slit across a central part of the disk and of sufficient stiffness to normally keep closed the slit and to return the slit to a closed condition after an implement such as a blunt ended tip of an oral syringe is pushed through the slit. The two liquid dispensing elements 26, 28 shown above may be replaced by other combinations of two dispensers, such as two flow reducer openings of larger and smaller size, or two elastomeric septa, among still other possibilities.

While a particular embodiment of the invention has been described and illustrated for purposes of clarity and example, it should be understood that many changes, modifications and substitutions will become apparent to those having only ordinary skill in the art without thereby departing from the claimed invention. In particular, individual features of the dosing cap here shown and described may be included or omitted in different combinations in any given dosing cap.

What is claimed as new is:

1. A dual function dosing cap comprising a cap assembly adapted for attachment to a neck of a bottle so as to close the neck against flow of liquid content from the bottle; first and second liquid dispensers in said cap assembly and a lid assembly on said cap assembly displaceable between an open position and a closed position, said open position enabling access to only one or the other of said liquid dispensers, corking plugs on said lid assembly for corking said other of said liquid dispensers in said open position, and a closed position barring access to both said liquid dispensers, said lid assembly having cap elements dependent therefrom for capping one or both of said liquid dispensers in said closed position.

2. The dosing cap of claim 1 wherein said first and second liquid dispensers include a flow reducer opening in said cap assembly as one of said liquid dispensers and a normally closed elastomeric septum penetrable with a tip of an oral syringe as the other of said liquid dispensers.

3. The dosing cap of claim 2 wherein said cap assembly comprises an inner cap engageable to a said bottle neck and an outer cap rotatable on said inner cap; said inner cap having said septum and said flow reducer opening therein; said outer cap bearing said lid assembly, wherein rotation of said outer cap turns said lid assembly between an open position admitting selective access to either said flow reducer opening or said elastomeric septum and a closed position barring access to both said flow reducer opening and said septum.

4. The dosing cap of claim 3 wherein said outer cap has a cap top and first and second access holes in said top, said access holes being in overlying alignment with said flow restrictor opening and said elastomeric septum in said open position, and away from said overlying alignment in said closed position thereby preventing access to either of said flow restrictor opening and said elastomeric septum.

5. The dosing cap of claim 4 wherein said lid assembly comprises first and second lids each for covering one of said flow restrictor opening and said septum, and said corking plugs are on said lids for corking one or both said opening and said septum in said open position of said outer cap, wherein said lid assembly is constructed and configured such that each of said lids when in open position substantially stops the other of said lids from opening.

6. The dosing cap of claim 4 wherein said outer cap has said cap elements dependent therefrom for capping one or both said opening and said septum in said closed position of said outer cap.

7. The dosing cap of claim 5 further comprising fluid ducts connecting said each of said access holes to a corresponding one of said flow restrictor openings and said elastomeric septum, wherein said ducts include telescopically mating upper and lower duct segments attached to said upper and lower cap respectively.

8. The dosing cap of claim 7 wherein said upper cap is axially movable relative to said lower cap for uncoupling said duct segments thereby to free said upper cap for rotation relative to said lower cap and for telescopically coupling said duct segments following rotation to one of said open and closed positions, and for unseating said corking plugs from said flow restrictor opening and said septum thereby to free said upper cap for rotation relative to said lower cap and for seating said corking plugs in said flow restrictor opening and said septum in either said open or said closed positions.

9. The dosing cap of claim 3 further comprising at least one cap locking detent for locking said outer cap against rotation relative to said inner cap in either or both of said open and said closed positions.

10. The dosing cap of claim 9 wherein said least one cap locking detent comprises a push pin on one of said caps engageable into one or more detent holes in the other of said caps, wherein said push pin is radially movable into and out of said detent holes and is normally biased towards entry into one of said detent holes as said detent hole comes into alignment with said push pin when said outer cap is turned over said inner cap thereby to lock the caps against relative rotation.

11. The dosing cap of claim 4 further comprising at least one guide slot in one of said caps and a guide pin on the other of said caps, said guide pin captive in said guide slot for guiding and limiting movement of said outer cap relative to said inner cap.

12. A dual function dosing cap comprising an inner cap adapted for closing a pouring aperture of a container and an outer cap rotatable on said inner cap;

first and second liquid dispensers on said inner cap;

first and second access holes on said outer cap;

said access holes being in overlying alignment with respective ones of said liquid dispensers in an open position of said outer cap, and wherein rotation of said outer cap to a closed position moves said access holes out of said overlying alignment;

first and second lids hinged to said outer cap for individual lifting open and closing for covering said first and second access holes respectively in a closed condition of said lids;

and further comprising ducts for directing liquid between each of said liquid dispensers and a corresponding one of said access holes thereby to contain liquid against leakage between said outer cap and said inner cap.

13. The dosing cap of claim 12 wherein said lids are hinged to a top of said outer cap along a hinge line diametric to said top of said outer cap and said outer cap is turned ninety degrees from said open condition to said closed condition wherein said hinge line is transverse to a diameter line joining said first and second liquid dispensers.

14. The dosing cap of claim 12 further comprising at least one cap locking detent for locking said outer cap against rotation relative to said inner cap in either or both of said open and said closed positions.

15. The dosing cap of claim 14 wherein said least one cap locking detent comprises a push pin on one of said caps engageable with one or more detent holes in the other of said caps.

16. The dosing cap of claim 15 wherein said push pin is movable between a radially extended and a radially depressed position and is normally biased towards said extended position such that said pin enters one of said detent holes as it comes into alignment with said push pin when said outer cap is turned over said inner cap thereby locking the caps against relative rotation.

17. The dosing cap of claim 12 wherein each said duct includes an upper duct segment dependent from said outer cap and a lower duct segment rising from said inner cap and wherein said upper and said lower duct segments couple telescopically one with the other to form continuous ducts between said outer cap and said inner cap.

18. The dosing cap of claim 17 wherein said outer cap is also axially displaceable to and from said inner cap thereby to couple and uncouple said duct segments when rotating said outer cap between said open and said closed positions.

19. The dosing cap of claim 12 further comprising a first pair of plug elements dependent one from each of said lids for corking said first and said second liquid dispensers in a closed condition of said lids and an open position of said outer cap, a second pair of stopper elements dependent from an underside of said outer cap for capping said first and said second liquid dispensers in a closed position of said outer cap, and wherein said outer cap is also axially displaceable to and from said inner cap thereby to unseat said plug elements and said cap elements from said liquid dispensers to free said outer cap for rotation between said open and said closed positions and to seat said plug elements and cap elements onto said liquid dispensers following such rotation.

20. A dual function dosing cap comprising an inner cap adapted to make retentive engagement with a neck of a bottle, an outer cap rotatable on said inner cap; first and second liquid dispensing means on said inner cap for pouring or drawing liquid contained in a said bottle; and first and second lids hinged to said outer cap, each of said lids covering one of said dispensing means such that lifting of one of said lids for access to one of said dispensing means substantially prevents lifting of the other of said lids for access to the other of said dispensing means.

21. The dosing cap of claim 20 further comprising first and second detents for locking said outer cap against rotation relative to said inner cap in an open or a closed conditions respectively, said dispensing means being accessible under said lids only in said open condition.

22. The dosing cap of claim 20 further in combination with a necked bottle wherein said cap assembly comprises first cap retaining means for making permanent interlocking engagement with second cap retaining means on said necked bottle such that said dosing cap is not readily detachable from said necked bottle by pulling or twisting.

* * * * *